US010201200B2

(12) United States Patent
Kolmes

(10) Patent No.: US 10,201,200 B2
(45) Date of Patent: Feb. 12, 2019

(54) GLOVE WITH IMPROVED INDEX FINGER PRECISION MADE FROM REINFORCED MULTILAYER MATERIAL

(71) Applicant: SUPREME CORPORATION, Hickory, NC (US)

(72) Inventor: Matthew L. Kolmes, Denver, NC (US)

(73) Assignee: SUPREME CORPORATION, Hickory, NC (US)

( * ) Notice: Subject to any disclaimer, the term of this patent is extended or adjusted under 35 U.S.C. 154(b) by 185 days.

(21) Appl. No.: 15/072,904

(22) Filed: Mar. 17, 2016

(65) Prior Publication Data

US 2017/0265540 A1 Sep. 21, 2017

(51) Int. Cl.

| | |
|---|---|
| ***A41D 19/015*** | (2006.01) |
| ***A41D 19/00*** | (2006.01) |
| ***A41D 27/28*** | (2006.01) |
| ***A41D 31/00*** | (2006.01) |

(52) U.S. Cl.

CPC ... *A41D 19/01505* (2013.01); *A41D 19/0006* (2013.01); *A41D 19/0048* (2013.01); *A41D 19/015* (2013.01); *A41D 27/28* (2013.01); *A41D 31/0061* (2013.01); *A41D 2400/62* (2013.01)

(58) Field of Classification Search

CPC ..... A41D 13/08; A41D 19/00; A41D 19/015; A63B 71/148; A61B 19/04

See application file for complete search history.

(56) References Cited

U.S. PATENT DOCUMENTS

| | | | | |
|---|---|---|---|---|
| 4,094,014 | A | 6/1978 | Schroeder | |
| 5,822,795 | A | 10/1998 | Gold | |
| 5,974,588 | A | 11/1999 | Furman | |
| 6,457,182 | B1 * | 10/2002 | Szczesuil | A41D 19/01511 2/16 |
| 6,467,251 | B1 | 10/2002 | Kolmes | |
| 9,161,579 | B1 * | 10/2015 | Johnson | A41D 19/01505 |
| 2002/0106956 | A1 | 8/2002 | Howland | |
| 2006/0156453 | A1 | 7/2006 | Lee | |
| 2007/0137164 | A1 | 6/2007 | Kolmes et al. | |
| 2010/0050699 | A1 | 3/2010 | Kolmes et al. | |
| 2011/0179551 | A1 * | 7/2011 | VanErmen | A41D 19/01558 2/161.6 |
| 2012/0159681 | A1 * | 6/2012 | Gibby | A41D 13/0156 2/20 |
| 2012/0311754 | A1 * | 12/2012 | Safford | A41D 19/015 2/20 |

(Continued)

OTHER PUBLICATIONS

International Search Report and Written Opinion with Search History dated Jun. 9, 2017 in PCT/US17/22659.

(Continued)

*Primary Examiner* — Tejash Patel

(74) *Attorney, Agent, or Firm* — Oblon, McClelland, Maier & Neustadt, L.L.P.

(57) ABSTRACT

A glove made from a reinforced multilayer material can prevent cuts and/or abrasions. The glove can include and exterior layer and at least one interior layer, the interior layer consisting of an ultra-high molecular weight polyethylene filaments. While the interior layer can entirely cover a hand of a wearer of the glove, the exterior layer does not cover the index finger of the wearer, such that the wearer's dexterity, precision, and sensitivity in their index finger are improved.

17 Claims, 4 Drawing Sheets

(56) References Cited

U.S. PATENT DOCUMENTS

| | | | | |
|---|---|---|---|---|
| 2014/0026280 | A1 | 1/2014 | Clark | |
| 2014/0237701 | A1* | 8/2014 | Thompson | A41D 19/001 2/164 |
| 2014/0283559 | A1* | 9/2014 | Andrews | A41D 19/01505 66/174 |
| 2016/0029721 | A1* | 2/2016 | Sheehy | A41D 19/01505 2/16 |

OTHER PUBLICATIONS

Chinese Allowance Notice dated Oct. 31, 2016 in Patent Application No. 201620657638.7 (without English Translation).
Chinese Notification of Grant dated Oct. 31, 2016 in Patent Application No. 201620657638.7 (without English Translation).

* cited by examiner

GLOVE WITH IMPROVED INDEX FINGER PRECISION MADE FROM REINFORCED MULTILAYER MATERIAL

FIELD OF THE DISCLOSURE

The present disclosure relates to an apparatus including a multilayer material that is reinforced to provide cut and/or abrasion resistance.

BACKGROUND

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

In many industries and professions there is a need for protective wear that is cut and/or abrasion resistant, yet lightweight and comfortable for the wearer. From maintenance workers crawling through HVAC ventilation shafts to weekend warriors participating in various sporting events to police officers having to confront knife wielding assailants, many individuals need protection from cuts and scrapes as they go about their daily activity.

However, previously proposed protective garments are unwieldy and uncomfortable to the wearer, do not permit airflow therethrough, do not permit the escape of excess water vapor from the skin of the wearer, and may be less precise in their intended movement meaning the human body may not be able to move, react, interact, etc. as effectively.

SUMMARY

The foregoing paragraphs have been provided by way of general introduction, and are not intended to limit the scope of the following claims. The described embodiments, together with further advantages, will be best understood by reference to the following detailed description taken in conjunction with the accompanying drawings.

It is an object of the disclosed subject matter to overcome these or other disadvantages of known protective gloves.

It is a further object of the disclosed subject matter to provide a leather garment, such as a leather glove, made of the multilayer material, wherein the outer layer is leather.

These and other objects of the disclosed subject matter can be provided by a reinforced multilayer material comprising an outer layer, preferably configured to resist damage, a first interior layer comprising a fabric made from a composite cut and abrasion resistant yarn and being lightweight, resistant to damage, and permitting air and water vapor to flow therethrough, and optionally a second interior layer, wherein the first interior layer is between the exterior layer and the second interior layer, and a protective garment, such as a glove, made therefrom.

The present invention can further provide a method of protecting a hand of a wearer of a glove from injury, using the glove of the disclosed subject matter. The method includes disposing a first interior layer of the glove directly in contact with the hand of the wearer, the first interior layer including a light-weight, cut and/or abrasion resistant material able to prevent injuries to the wearer of the glove, and disposing an outer layer above the first interior layer, the outer layer providing resistance to damage to a lesser extent than the first interior layer. In a further embodiment, the method can further comprise disposing a second interior layer between the hand of the wearer and the first interior layer for added comfort and feel.

The present invention can further provide a method of allowing increased flexibility, control, sensitivity, and the like of an index finger of a wearer of a glove, using the glove of the disclosed subject matter. The method includes disposing a first interior layer of the glove directly in contact with the hand of the wearer, the first interior layer including a light-weight, cut and/or abrasion resistant material able to prevent injuries to the wearer of the glove, and disposing an outer layer above the first interior layer except where the first interior layer covers an index finger of the wearer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
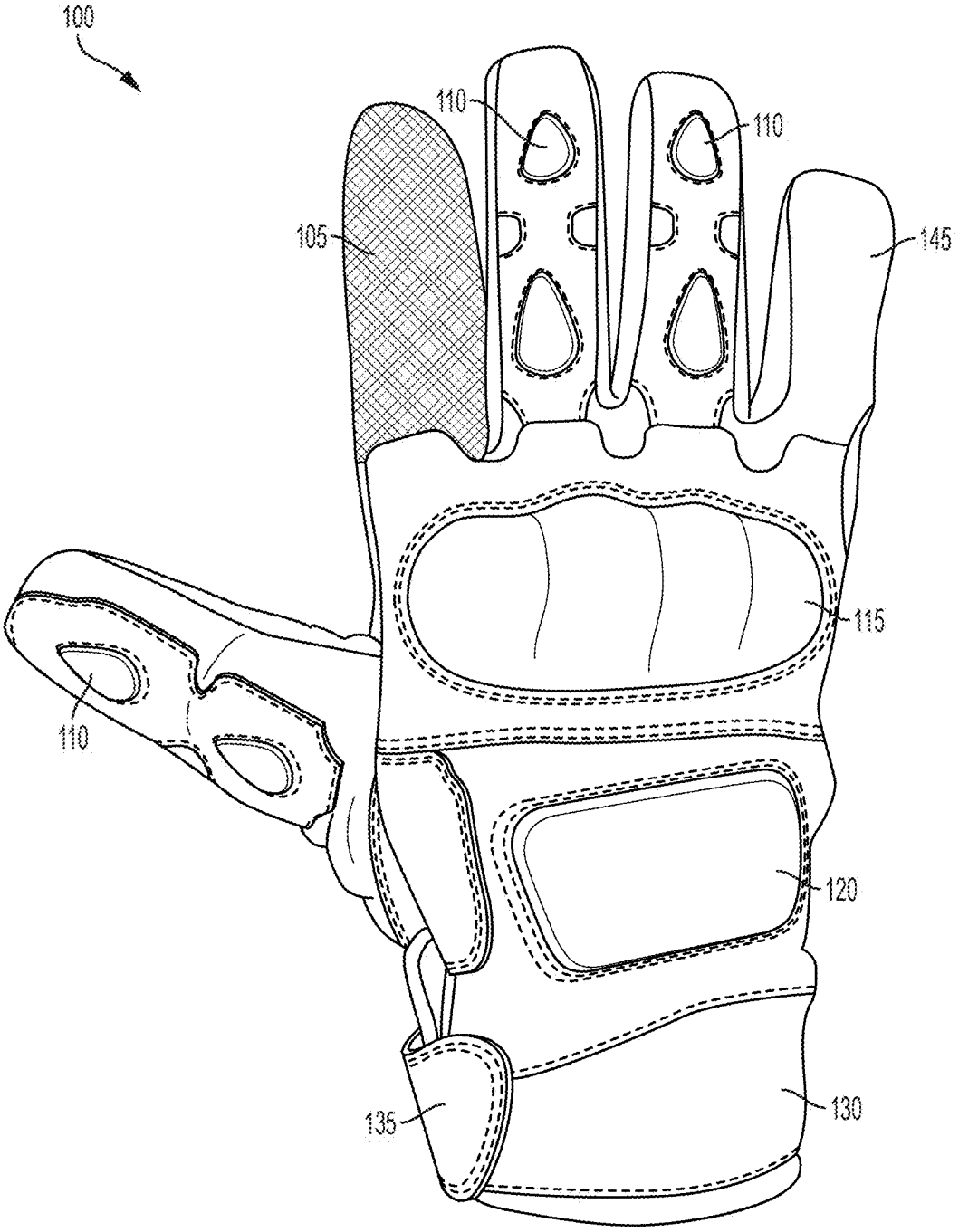
FIG. 1 depicts an aerial view of a glove in a palm-away position according to one or more embodiments of the disclosed subject matter.

The description set forth below in connection with the appended drawings is intended as a description of various embodiments of the disclosed subject matter and is not necessarily intended to represent the only embodiment(s). In certain instances, the description includes specific details for the purpose of providing an understanding of the disclosed subject matter. However, it will be apparent to those skilled in the art that embodiments may be practiced without these specific details. In some instances, well-known structures and components may be shown in block diagram form in order to avoid obscuring the concepts of the disclosed subject matter.

Reference throughout the specification to "one embodiment" or "an embodiment" means that a particular feature, structure, characteristic, operation, or function described in connection with an embodiment is included in at least one embodiment of the disclosed subject matter. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments. Further, it is intended that embodiments of the disclosed subject matter can and do cover modifications and variations of the described embodiments.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the disclosed subject matter to any particular orientation or configuration. Furthermore, terms such as "first," "second," "third," etc., merely identify one of a number of portions, components, points of reference, operations and/or functions as described herein, and likewise do not necessarily limit embodiments of the disclosed subject matter to any particular configuration or orientation.

The term "fiber" as used herein refers to a fundamental component used in the assembly of yarns and fabrics. Generally, a fiber is a component which has a length dimension which is much greater than its diameter or width. This term includes ribbon, strip, staple, and other forms of chopped, cut or discontinuous fiber and the like having a regular or irregular cross section. "Fiber" also includes a plurality of any one of the above or a combination of the above.

As used herein, the term "high performance fiber" means that class of synthetic or natural non-glass fibers having high values of tenacity greater than 10 g/denier, such that they lend themselves for applications where high abrasion and/or cut resistance is important. Typically, high performance fibers have a very high degree of molecular orientation and crystallinity in the final fiber structure.

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or crenular, bean-shaped or others.

The term "intimate blend" as used herein refers to a mixture of fibers of at least two types, wherein the mixture is formed in such a way that the individual filaments of each type of fiber are substantially completely intermixed with individual filaments of the other types to provide a substantially homogeneous mixture of fibers, having sufficient entanglement to maintain its integrity in further processing and use.

The term "stretch broken" as used herein refers to a process in which fibers are hot stretched and broken to produce short fiber lengths, rather than cutting, in order to prevent some of the damage done by the cutting process.

The term "yarn" as used herein refers to a continuous strand of textile fibers, filaments or material in a form suitable for knitting, weaving, or otherwise intertwining to form a textile fabric. Yarn can occur in a variety of forms to include a spun yarn consisting of staple fibers usually bound together by twist; a multi filament yarn consisting of many continuous filaments or strands; or a mono filament yarn which consists of a single strand. A "blended yarn" as used herein refers to a yarn that comprises an intimate blend of at least two different types of fibers.

The term "end" as used herein refers to a single yarn ply used in preparation of multi-end yarns. The two or more ends may be put together by twisting together, wrapping a cover wrap around the combined ends or by air-interlacing as described below.

The term "composite yarn" refers to a yarn prepared from two or more yarns, which can be the same or different. Composite yarn can occur in a variety of forms wherein the two or more yarns are in differing orientations relative to one another. The two or more yarns can, for example, be parallel, wrapped one around the other(s), twisted together, or combinations of any or all of these, as well as other orientations, depending on the properties of the composite yarn desired. Examples of such composite yarns are provided in U.S. Pat. No. 4,777,789, U.S. Pat. No. 4,838,017, U.S. Pat. No. 4,936,085, U.S. Pat. No. 5,177,948, U.S. Pat. No. 5,628,172, U.S. Pat. No. 5,632,137, U.S. Pat. No. 5,644,907, U.S. Pat. No. 5,655,358, U.S. Pat. No. 5,845,476, U.S. Pat. No. 6,212,914, U.S. Pat. No. 6,230,524, U.S. Pat. No. 6,341,483, U.S. Pat. No. 6,349,531, U.S. Pat. No. 6,363,703, U.S. Pat. No. 6,367,290, and U.S. Pat. No. 6,381,940, the contents of each of which are hereby incorporated by reference.

The term "air interlacing" as used herein refers to subjecting multiple strands of yarn to an air jet to combine the strands and thus form a single, intermittently commingled strand. This treatment is sometimes referred to as "air tacking." This term is not used to refer to the process of "intermingling" or "entangling" which is understood in the art to refer to a method of air compacting a multifilament yarn to facilitate its further processing, particularly in weaving processes. A yarn strand that has been intermingled typically is not combined with another yarn. Rather, the individual multifilament strands are entangled with each other within the confines of the single strand. This air compacting is used as a substitute for yarn sizing and as a means to provide improved pick resistance. This term also does not refer to well-known air texturizing performed to increase the bulk of single yarn or multiple yarn strands. Methods of air interlacing in composite yarns and suitable apparatus therefore are described in U.S. Pat. Nos. 6,349,531; 6,341,483; and 6,212,914, the relevant portions of which are hereby incorporated by reference.

The term "composite fabric" is used herein to indicate a fabric prepared from two or more different types of yarn or composite yarn. The fabric construction can be any type, including but not limited to, woven, knitted, non-woven, etc. The two or more different types of yarn or composite yarn include, but are not limited to, those made from natural fibers, synthetic fibers and combinations thereof.

The term "composite article" is used herein to indicate a final article that comprises at least two different types of materials. The composite article can be prepared from a composite fabric, or can be prepared from a conventional fabric containing only one type of yarn, but is put together using a yarn or sewing thread made of a different material. Alternatively, the conventional fabric can be sewn together using a composite yarn as the sewing thread. Composite articles can be any form, including but not limited to, gloves, aprons, socks, filters, shirts, pants, undergarments, one-piece jumpsuits, etc. All of these types of articles, as well as other permutations that are readily evident to those of skill in the art, are included in the present invention definition of "composite article".

For convenience, the term "yarn component" as used herein, encompasses fiber, monofilament, multifilament and yarn.

The disclosed subject matter relates to a multilayer material, wherein an exterior layer of the material provides one or more advantages such as damage resistance, nice appearance, desired color, etc., while a first interior layer comprises a cut and/or abrasion resistant fabric made from at least one cut and/or abrasion resistant yarn, which may be assembled in any manner. Suitable cut and/or abrasion resistant fabrics include woven, knit and non-woven fabrics. Suitable composite yarns which may be used to prepare the cut and/or abrasion resistant fabric include, but are not limited to, those as incorporated by reference above. Each of the patents disclose composite yarns and fabrics that are well suited for use in the cut and/or abrasion resistant fabric of the first interior layer disclosed herein. Each of these composite yarns is one or more of strong, light-weight, easily woven into a fabric, resistant to damage, able to permit air and water vapor flow, and able to prevent or decrease the seriousness of an injury from cuts or abrasions to a portion of the body of the wearer covered by the fabric.

The multilayer material of the disclosed subject matter may comprise one or more additional interior layers, either between the first interior layer and the exterior layer, on a side of the first interior layer away from the exterior layer, or both. These additional interior layers may be made of any desired material, including, but not limited to, fabrics from natural or synthetic fibers, such as cotton, rayon, silk, polyester, and nylon, animal hides and furs, and even polymers such as latex.

In the multilayer material of the disclosed subject matter, the first interior layer and exterior layer are affixed one to the other, either directly or through an intermediate layer of material. Within the context of the disclosed subject matter, the term "affixed" can indicate attachment (either directly or indirectly) at a single location or a plurality of locations, up to attachment of the first interior layer to the exterior layer having essentially complete contact and affixation of the sides of the layers which are facing one another. The affixing can be by any method sufficient to avoid disconnection between the layers, and is preferably by stitching the layers together or by use of an adhesive.

The optional one or more additional layers are also preferably affixed to the layer or layers to which they are adjacent by similar techniques. These additional one or more layers are preferably used to provide better feel to the wearer (in the event of a glove or like article of clothing), to provide added warmth, or even to provide waterproofing, as desired. The choice of material used for the one or more additional layers is dependent on the property sought and is readily apparent to one of ordinary skill in the art.

In a further embodiment of the disclosed subject matter, a garment is provided that has an exterior layer, such as leather, with a first interior layer affixed to the underside of the exterior layer, wherein the first interior layer is made from a fabric formed of a cut and abrasion resistant composite yarn. An optional second interior layer can be used between the wearer and the first interior layer to provide better comfort and feel if desired. The second interior layer can be made from any desired material, such as silk, cotton, wool, or other typical clothing fibers. The garment can preferably be in the form of a glove, and is particularly suited for high risk activities, where there is a risk of contact between the wearer and the ground at high speeds, such as riding a motorcycle, or contact between the wearer and a sharp object, such as a knife.

It is noted that in various embodiments of the invention, one or more of the linings or layers can permit the flow of water vapor therethrough, or can permit the flow of air therethrough. By this arrangement, perspiration on the skin of the wearer of the protecting component is permitted to evaporate, or the wearer of the protecting component can be cooled, without removal of the protecting component.

In a preferred embodiment of the present invention, leather gloves having a first interior layer formed of the fabric formed from cut and/or abrasion resistant composite yarn are provided with significantly improved cut resistance. The inventors have found that even drawing of a razor knife across the flattened leather glove made from the multilayer material of the present invention, shows no penetration or cutting of the cut and/or abrasion resistant composite yarn fabric, even while the leather exterior layer is slashed open. This test is performed against a hard surface such as a table top, which would be more likely to cause cutting of the fabric made from the composite yarn as compared to passing the razor knife across the glove while being worn by a person, such as a police officer. The cut and abrasion resistance afforded by the multilayer material of the present invention would thus provide an added layer of safety for the wearer, while maintaining desired comfort.

Previous composite yarn based gloves have been proposed in the various patents mentioned above regarding composite yarns. However, these gloves were typically knit directly from the composite yarn, and while providing adequate cut protection, were not aesthetically pleasing, as there was no exterior layer such as required in the present invention, nor was there proposed an optional one or more additional layers for comfort purposes.

Due to the protection afforded by materials used in the exterior layer of the present invention, such as leather or aramids, the first interior layer may be made of composite yarns having smaller overall yarn size, preferably having a composite denier of from 300 to 5000, more preferably from 400 to 4500, including all subranges therein. This allows the cut and/or abrasion resistant layer to be lighter, more flexible and still provide sufficient cut and/or abrasion resistance, particularly in combination with the protective nature of the exterior layer.

The high performance fiber of the disclosed subject matter can be any desired high performance fiber. Preferably the high performance fiber comprises an high molecular weight polyolefin, preferably ultra-high molecular weight polyethylene (UHMWPE) or high molecular weight polypropylene, an aramid, a high molecular weight polyvinyl alcohol, a high molecular weight polyacrylonitrile, liquid crystal polyesters or mixtures or copolymers thereof. The high performance fiber can also be a fiber blend, such as those described in U.S. Pat. No. 7,214,425, hereby incorporated by reference, wherein the high performance fiber is preferably included as a stretch broken fiber blended with one or more other yarns, which may also be high performance fibers themselves if desired.

U.S. Pat. No. 4,457,985, hereby incorporated by reference, generally discusses high molecular weight polyethylene and polypropylene fibers. In the case of polyethylene, suitable fibers are those of molecular weight of at least 150,000, preferably at least 400,000, more preferably at least one million and most preferably between two million and five million. Such extended chain polyethylene (ECPE) (or ultra-high molecular weight polyethylene, UHMWPE) fibers may be grown in solution as described in U.S. Pat. No. 4,137,394 or U.S. Pat. No. 4,356,138, hereby incorporated by reference, or may be a filament spun from a solution to form a gel structure, as described in German Off. 3 004 699 and GB 2 051 667, and especially described in U.S. Pat. No. 4,551,296, hereby incorporated by reference. As used herein, the term polyethylene preferably means a predominantly linear polyethylene material that may contain minor amounts of chain branching or comonomers not exceeding 5 modifying units per 100 main chain carbon atoms, and that may also contain admixed therewith not more than about 50 weight percent of one or more polymeric additives such as alkene-1-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as lubricants, colorants and the like which are commonly incorporated by reference. Depending upon the formation technique, the draw ratio and temperatures, and other conditions, a variety of properties can be imparted to these fibers. The tenacity of the fibers should preferably be at least 15 g/d, more preferably at least 20 g/d, even more preferably at least 25 g/d and most preferably at least 28 g/d. Similarly, the tensile modulus of the filaments, as measured by an Instron tensile testing machine, is preferably at least 300 g/d, more preferably at least 500 g/d and still more preferably at least 1,000 g/d and most preferably at least 1,200 g/d. These highest values for tensile modulus and tenacity are generally obtainable only by employing solution grown or gel fiber processes. For example, ultra-high molecular weight polyethylene filaments produced commercially by Honeywell Corp. under the trade name SPECTRA or by DSM under the trade name DYNEEMA and having moderately high moduli and tenacity are particularly useful.

Referring now to the drawings, wherein like reference numerals designate identical or corresponding parts throughout the several views.

FIG. 1 depicts a back of a glove 100 in one or more embodiments of the disclosed subject matter. The glove 100 can include an exterior layer 145. The exterior layer 145 can be made of leather, for example. The exterior layer 145 can include a first interior layer 105 affixed to the underside of the exterior layer 145, wherein the first interior layer 105 is made from a fabric formed of a cut and abrasion resistant composite yarn as described herein. The first interior layer 105 can entirely cover a hand of a wearer of the glove 100. The exterior layer 145 can cover at least a portion of the hand of the wearer of the glove 100. More specifically, the exterior layer 145 does not cover an index finger of the wearer. The exterior layer 145 may extend to a point at least past the third knuckle but not past the second knuckle. The index finger of the wearer is not covered by the exterior layer 145 for various performance and comfort reasons which can be important for very high risk situations. For example, not including the exterior layer 145 on the index finger of the wearer can significantly improve the dexterity of the index finger of the wearer. The dexterity is important for police officers, military personnel, and the like who may need to control a firearm, the index finger being the finger of the wearer that most commonly interacts with the trigger of the firearm. The exterior layer 145 around the index finger may prevent range of motion, sensitivity, and the like, and/or the additional material may get caught, hung up, add additional bulk, or may slow down the movement of the index finger in general. However, it may be important that the exterior layer 145 may remain covering the remainder of the hand of the wearer for various reasons including aesthetics, uniform consistency, warmth, built in padding, and the like.

The glove 100 can include soft knuckle pads 110 covering a first knuckle and a second knuckle of a middle finger, a ring finger, and a thumb to provide further protection from any contact with the knuckles. The soft knuckle pads 110 can be integrated into the exterior layer 145. The glove 100 can also include a hard knuckle protector 115 covering a third knuckle of each of the index finger, the middle finger, the ring finger, and a pinky finger. The hard knuckle protector 115 can be any rigid protective material, preferably plastic or metal, more preferably plastic selected from polycarbonates, or similar rigid plastics. The hard knuckle protector may be one piece of the material covering the third knuckle of each of the index, middle, ring, and pinky fingers without separation and includes contours to comfortably cover each third knuckle. More specifically, the height of the hard knuckle protector 115 may increase over the knuckle, and decrease in between knuckles. The hard knuckle protector 115 may be used for defensive purposes as the knuckle protector 115 may protect the third knuckles from cuts/abrasions, forceful contact from hand-to-hand combat (e.g., punching), and the like. Additionally, the hard knuckle protector may be used offensively as the hard material may cause more damage to anything the hard knuckle protector 115 contacts.

The glove 100 may also include protective padding 120. The protective padding 120 can cover at least a portion of a back of the hand of the wearer of the glove 100 to provide an additional cushion against any contact with the back of the hand of the wearer.

The glove 100 may also include an adjustable wrist strap 130 to adjust the tightness of the glove 100 around the wrist to secure the glove 100 to the wearer and prevent unanticipated removal of the glove 100. In connection with the wrist strap 130, the glove 100 can also include a connection strap 135, which may make a secure connection via Velcro, for example, to adjust the size of the wrist strap 130, as well as secure the wrist strap 130 to a predetermined position as may be determined and/or adjusted by the wearer of the glove 100. It should be appreciated that the wrist strap 130 and the connection strap 135 may be considered a single wrist strap adjustment mechanism via the combination of the wrist strap 130 and the connection strap 135.

Figure 2:
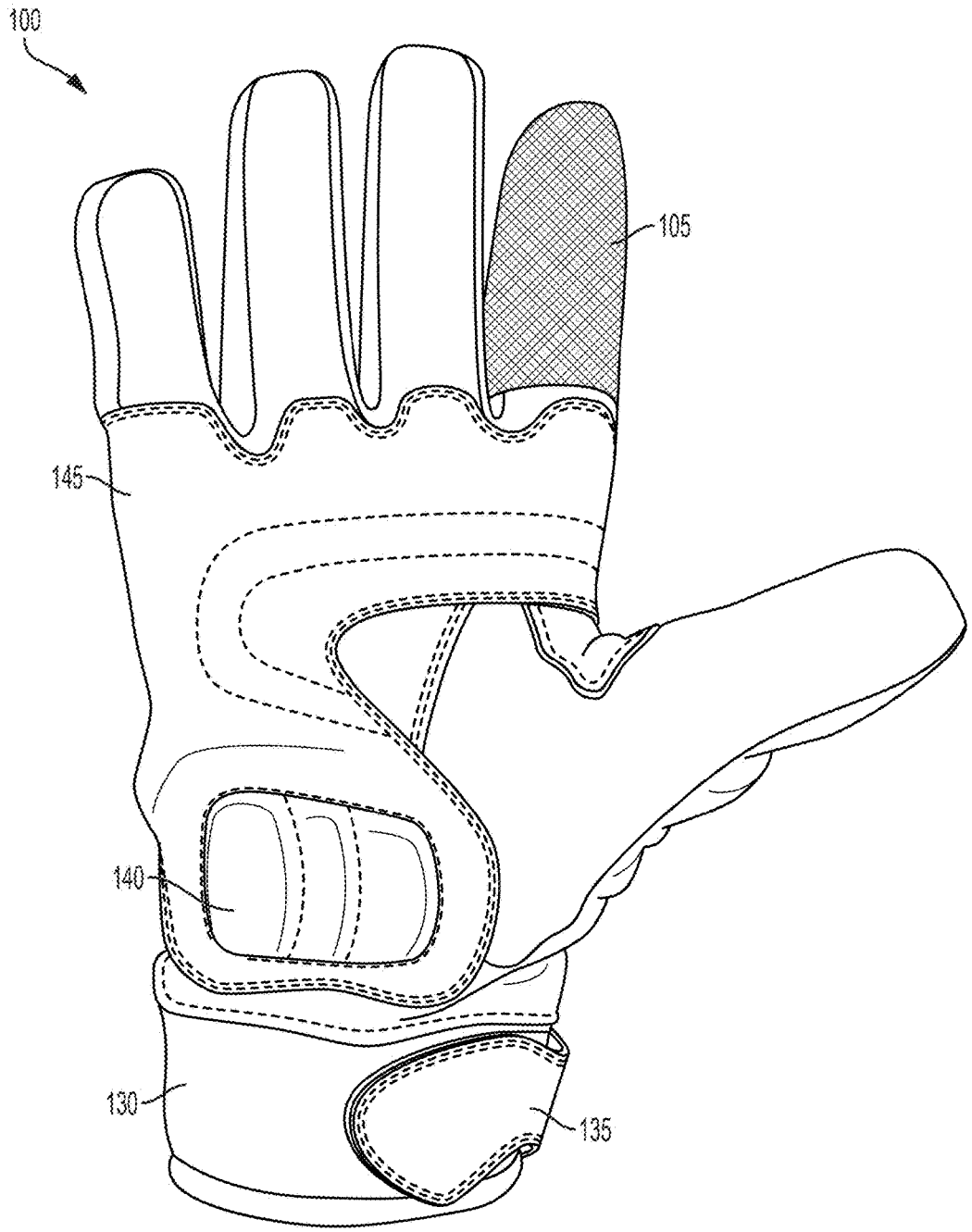
FIG. 2 depicts an aerial view of the glove in a palm-facing position according to one or more embodiments of the disclosed subject matter.

FIG. 2 depicts a view of the palm-side of the glove 100. The glove 100 can also include palm protection pads 140. The palm protection pads 140 can cover at least a portion of the palm of the wearer. The palm protection pads 140 may be strategically placed to reduce impact on the palm caused by recoil of a firearm, for example. The palm protection pads 140 can be integrated into the exterior layer 145.

The wrist strap 130 may be made of a second exterior material while still part of the exterior layer 145. The material of the wrist strap 130 can be any desired material, preferably formed from a natural or synthetic fiber, more preferably a stretch fiber, most preferably stretch nylon or stretch polyurethane. The connection strap 135 may be made of the same material as the rest of the exterior layer 145, such as leather, for aesthetic reasons, grip, durability, and the like.

Additionally, the first interior layer 105 is depicted as covering the palm-side of the index finger as well, thereby fully covering the index finger where the index finger includes at least the first and second knuckles.

Figure 3:
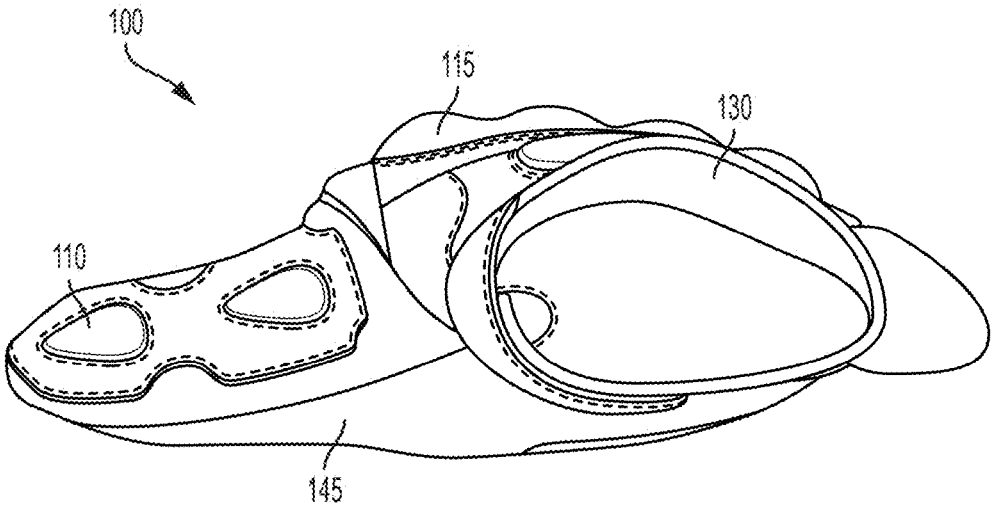
FIG. 3 depicts a longitudinal view of the glove with no interior lining according to one or more embodiments of the disclosed subject matter.

FIG. 3 depicts a longitudinal view of the glove 100 including a view of the preferred entrance for the user's hand to wear the glove 100. In one or more embodiments, the glove 100 may not include an interior layer 105 other than where the interior layer 105 covers the index finger as in FIG. 1 and FIG. 2. However, the glove 100 may still include the exterior layer 145, the soft knuckle pads 110, the hard knuckle protector 115, the wrist strap 130, etc.

Figure 4:
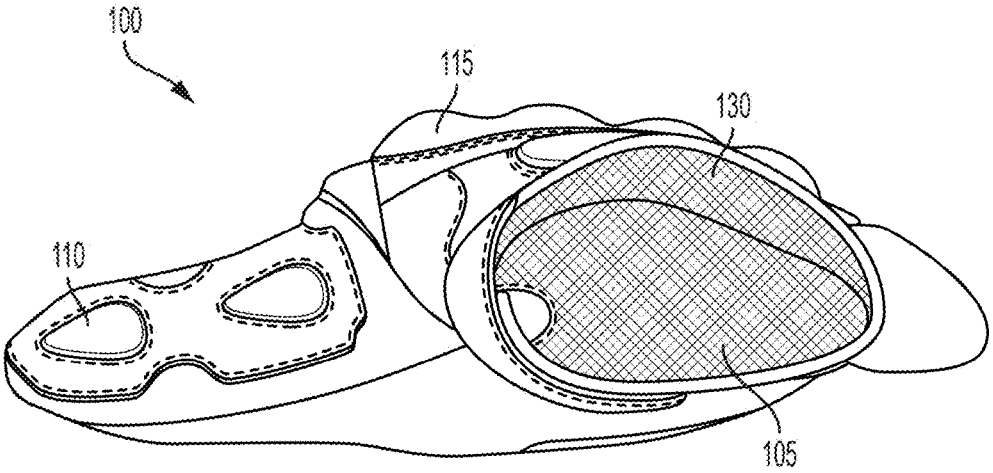
FIG. 4 depicts a longitudinal view of the glove with an interior lining according to one or more embodiments of the disclosed subject matter.

FIG. 4 depicts a longitudinal view of the glove including interior layer 105. The interior layer 105 may entirely cover the hand of a wearer of the glove 100. The glove may still include the soft knuckle pads 110, the hard knuckle protector 115, the wrist strap 130, and the like as described herein. However, in the embodiment depicted in FIG. 4, the interior layer 100 extends at least over an entirety of an inner surface of the exterior layer 145 such that the interior layer is positioned between the exterior layer 145 and the hand of the wearer of the glove 100. Thus, the hand of the wearer of the glove 100 would not contact the exterior layer 145 while the glove 100 is on the wearer's hand. In another exemplary embodiment, the interior layer 100 extends at least over an entirety of an inner surface of the exterior layer 145 and at least over part of the wrist strap 130. Thus, in this embodiment, the wearer's hand may come in contact with part of the wrist strap 130 while wearing the glove 100.

An advantage of the glove 100 is a configuration for optimal precision and protection. The first interior layer 105 includes material that is beneficial in many combat scenarios, for example, such that the material prevents cuts and abrasions. The material used in the first interior layer 105 may prevent a knife from harming the hand of the wearer of the dove 100. In addition to the safety, removing the exterior layer 145 from the index finger, such that the glove 100 does not include any additional material covering the first interior layer 105 on the index finger (i.e. an interior of the first interior layer 105 contacts the index finger of the wearer directly and nothing is positioned on an exterior of the first interior layer 105 over the index finger), improves the mobility, dexterity, and sensitivity of the index finger, which may be crucial in extreme situations where lives may hang in the balance, for example, and the split second decisions and the precision required of those making the decisions should not be held back by any poor performance of equipment. When the crucial split-second decisions must be made, the wearer of the glove 100 can rely on the mobility, comfort, precision, and sensitivity of the first interior layer 105 covering the index finger where the index finger does not include the exterior layer 145.

Having now described embodiments of the disclosed subject matter, it should be apparent to those skilled in the art that the foregoing is merely illustrative and not limiting, having been presented by way of example only. Thus, although particular configurations have been discussed herein, other configurations can also be employed. Numerous modifications and other embodiments (e.g., combinations, rearrangements, etc.) are enabled by the present disclosure and are within the scope of one of ordinary skill in the art and are contemplated as falling within the scope of the disclosed subject matter and any equivalents thereto. Features of the disclosed embodiments can be combined, rearranged, omitted, etc., within the scope of the invention to produce additional embodiments. Furthermore, certain features may sometimes be used to advantage without a corresponding use of other features. Accordingly, Applicant (s) intend(s) to embrace all such alternatives, modifications, equivalents, and variations that are within the spirit and scope of the disclosed subject matter.

The invention claimed is:

1. A glove comprising:

a reinforced multilayer material, including an exterior layer having an exterior side and an interior side, the exterior layer being absent from an index finger of the glove from a tip of the index finger to where the index finger connects to a palm portion, and a first interior layer affixed to the interior side of the exterior layer and covering the index finger of the glove, the first interior layer comprising a fabric formed from a high performance fiber and being light-weight, cut and abrasion resistant, and permitting air and water vapor to flow therethrough; and a plurality of soft knuckle pads covering a first knuckle and a second knuckle of a middle finger, a ring finger, and a thumb.

2. The glove of claim 1, where in the high performance fiber comprises ultra-high molecular weight polyethylene filaments.

3. The glove of claim 2, wherein the high performance fiber comprises one or more composite yarns.

4. The glove of claim 1, further comprising:

a protective padding covering a portion of a back of the glove.

5. The glove of claim 4, further comprising:

a hard knuckle protector covering a third knuckle of each of the index finger, the middle finger, the ring finger, and a pinky finger.

6. The glove of claim 5, further comprising:

an adjustable wrist strap.

7. The glove of claim 6, further comprising:

a palm protection pad covering at least a portion of the palm of the glove.

8. The glove of claim 1, wherein the exterior layer extends past a third knuckle of the index finger.

9. The glove of claim 1, wherein the exterior layer does not extend past the second knuckle of the index finger.

10. The glove of claim 1, wherein a hard knuckle protector covers the third knuckle of each of the index finger, the middle finger, the ring finger, and the pinky finger with no separation between each third knuckle.

11. The glove of claim 6, wherein the adjustable wrist strap includes a strap connector.

12. The glove of claim 11, wherein the strap connector secures the adjustable wrist strap via a hook and loop material.

13. The glove of claim 1, wherein the first interior layer covers the entire hand including the index finger.

14. The glove of claim 1, wherein the first interior layer is attached to the exterior layer and covers only the index finger, other than where the first interior layer is attached to the exterior layer, at least past the second knuckle and prior to the third knuckle.

15. The glove of claim 1, wherein the exterior layer comprises at least one member selected from the group consisting of animal hides, vinyl, and fabrics made from synthetic of natural fibers.

16. The glove of claim 15, wherein the exterior layer comprises leather.

17. The glove of claim 1, further comprising at least one adhesive layer adhering the exterior and interior layers.

* * * * *